US006349430B1

(12) United States Patent
Forslund

(10) Patent No.: US 6,349,430 B1
(45) Date of Patent: Feb. 26, 2002

(54) AUTOMATIC PUBLIC TOILET

(75) Inventor: Göran Forslund, Nora (SE)

(73) Assignee: Danfo Sanitetssystem AB, Nora (SE)

( * ) Notice: Subject to any disclaimer, the term of this patent is extended or adjusted under 35 U.S.C. 154(b) by 0 days.

(21) Appl. No.: 09/561,417

(22) Filed: Apr. 28, 2000

(30) Foreign Application Priority Data

May 6, 1999 (EP) ..... 99850076

(51) Int. Cl.[7] ..... A47K 4/00; E03C 1/01
(52) U.S. Cl. ..... 4/662; 15/301; 52/65
(58) Field of Search ..... 4/662, 449, 233; 52/29, 65; 15/301, 302

(56) References Cited

U.S. PATENT DOCUMENTS 4,922,559 A * 5/1990 Wall ..... 4/662
5,755,160 A * 5/1998 Blufordcraving ..... 52/65

FOREIGN PATENT DOCUMENTS

| | | | |
|---|---|---|---|
| DE | 4006676 A1 | 9/1991 | ..... E03D/9/00 |
| DE | 4221508 A1 * | 1/1994 | ..... 4/662 |
| WO | WO9401627 | 1/1994 | |

* cited by examiner

*Primary Examiner*—Robert M. Fetsuga
*Assistant Examiner*—Tuan Nguyen
(74) *Attorney, Agent, or Firm*—Jones, Day , Reavis & Pogue

(57) ABSTRACT

An automatic public toilet for outdoor use has a public part confined by a roof, four walls and a floor, and comprises a lavatory unit including a toilet seat and bowl, the lavatory unit being supported on a wall of the toilet, wherein the floor is movable into and out of the public part of the toilet and the cleaning device for the floor is placed outside the public part. The floor is rotatable around a vertical axis.

4 Claims, 2 Drawing Sheets

AUTOMATIC PUBLIC TOILET

CROSS-REFERENCES TO RELATED APPLICATIONS

This application claims the benefit of European Patent Application No. 99850076.3, filed May 6, 1999.

BACKGROUND OF THE INVENTION

1. Field of the Invention

The present invention relates to an automatic public toilet for outdoor use having a public part confined by a roof, four walls, and comprising a lavatory unit including a toilet seat and bowl, the lavatory unit being supported on a wall of the toilet, wherein the floor is movable into and out of the public part of the toilet and the cleaning device for the floor is placed outside the public part.

2. Description of the Related Art

In order to provide a fresh and hygienic appearance for the user thereof, public toilets of the kind referred to above are automatically cleaned after use. Public toilets of the kind referred to above is known from DE-Al-40 06 676 and WO 94/01627, the floor in those toilets consisting of the upper part of an endless conveyer. The use of an endless conveyer requires a relatively large space under the floor and is a rather expensive construction. HYGIFLO®. JCDecaux, France commercialises an automatic public toilet in which the floor and the wall supporting the lavatory unit are tilted during cleaning, the cleaning of the lavatory unit and the floor being made with the same cleaning device. Such a cleaning device makes use of a lot of water for cleaning and demands also a powerful drying device for drying after cleaning.

The object of the present invention is to provide a floor and its cleaning device of a toilet of the aforementioned kind which is of a simple construction a can be produced in a cost effective manner.

SUMMARY OF THE INVENTION

This object is achieved by an automatic public toilet for outdoor use having a public part confined by a roof, four walls and a floor, and comprising a lavatory unit including a toilet seat and bowl, the lavatory unit being supported on a wall of the toilet, wherein the floor is movable into and out of the public part of the toilet and the cleaning device for the floor is placed outside the public part, characterised in that the floor is rotatable round a vertical axis.

In a preferred embodiment the cleaning device for the floor is disposed in a service part of the toilet and consists of a row of spray nozzles and a scraper. The row of downwardly directed spray nozzles is preferably supported by an elongated hollow bar and extend along the length thereof, the bar being extended in a horizontal direction from near the rotational centre of the floor a distance that at least is equal to the largest extension of the floor during the rotation thereof. Furthermore, the elongated bar is provided with a scraper element on the underside thereof. The floor is circular and contains an opening which extends radially from near the centre of the floor to the perimeter thereof or to a point near the perimeter of the floor and a waste basket having an opening with the same area as the opening in the floor is attached to the underside of the floor. Alternatively, the waste basket has the same longitudinal extension as the opening in the floor and is placed in the service part of the toilet under the scraper. The floor is advantageously perforated.

BRIEF DESCRIPTION OF THE DRAWINGS

The invention will now be described with reference to the enclosed Figures, of which.

DESCRIPTION OF AN EMBODIMENT OF THE INVENTION

Figure 1:
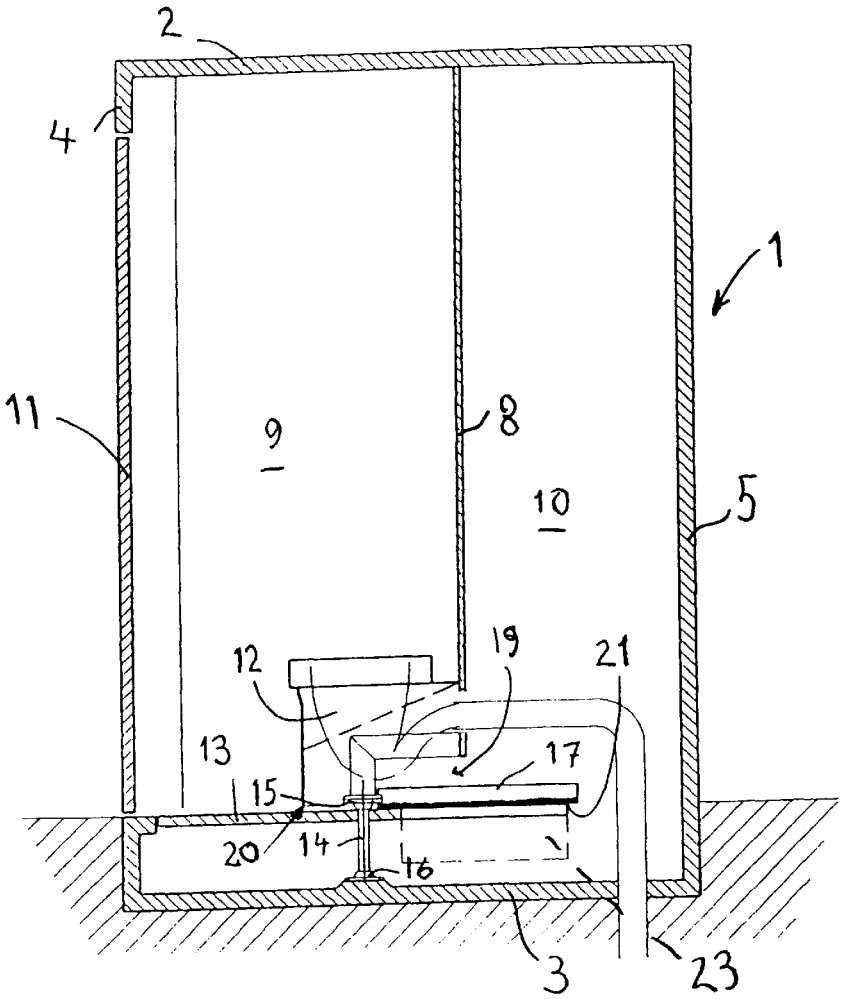
FIG. 1 is a schematic sectional side view of an embodiment of an automatic public toilet according to the invention.
Figure 2:
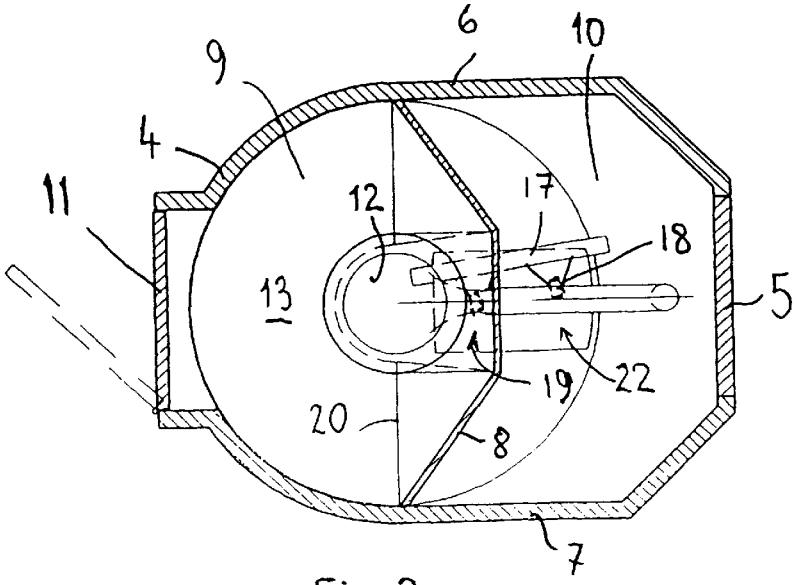
FIG. 2 is a schematic plan view, partly in section, of the toilet in FIG. 1 without the its roof

The automatic public toilet 1 disclosed in the Figures has a roof 2, a ground floor 3, a front wall 4, a rear wall 5, and two side walls 6 and 7. An inner wall 8 divides the toilet 1 into a public part 9 and a service part 10. A door 11 permits access to the public part 9. A lavatory unit 12 is contained in the public part and is supported by the inner wall 8 by any suitable means. A sink (not shown) is supported by one of the walls of the public part of the toilet.

The lavatory unit 12 used in the embodiment shown can be any self-cleaning lavatory unit on the market, such as a lavatory unit commercialised by Sanitaire Equipement, France under the trade mark HYGIFLO®. The cleaning device of this unit consists essentially of a rotatable seat, a wiper and an outlet for cleaning liquid located immediately before the wiper in the direction of the movement of the seat. The wiper and outlet are swingable from an inactive position to an active position. The self-cleaning device includes a course also regulating means for the operation thereof. A button permits manual flushing of the unit by the user. The lavatory unit is preferably supported by the wall 8 via weight sensors so that the presence of a person sitting on the seat can be detected.

According to the invention an inner floor 13 is fixed to an axle 14 which via suitable bearings 15, 16 is supported by the ground floor 3 and the inner wall 8 respectively. The axle 14 is, via a reduction gear, driven by a motor, preferably an electric motor, which for reasons of simplicity is not shown in the Figures. The floor 13 is preferably circular.

The floor cleaning device comprises an elongated bar 17 supporting a row of downwardly directed spray nozzles 18, of which only two are shown in the Figures. The bar 17 extends from a point near the rotation centre of the floor 13 in a horizontal direction and has such a length that cleaning liquid from the nozzles will reach the whole of the floor 13 when it is rotated 360°. Preferably, the bar 17 has a length that at least is equal to the radius of the floor and is placed so that the distance between the nozzles and the floor is small. As is evidence from FIG. 1, a portion of the bar 17 is extended under the inner wall 8 in a central part thereof, the wall 8 having a central opening 19 for this purpose. The lower edge 20 of the inner wall 8 ends a small distance above the floor 13.

The floor cleaning device also includes conduits (not shown) for feeding cleaning liquid to the spray nozzles and means for regulating the device (not shown). Such conduits and regulating means are well known to the skilled man and a detailed description thereof need not burden this text.

The floor cleaning device also include a scraper 21, for example a rubber strip affixed to the underside of the bar 17 and in contact with the upper side of the circular floor 13. The scraper 21 cooperates with an opening 22 in the floor 13. The opening 22 is extended from a point near the rotational axis of the floor 13 to a point near the circumference of the floor 13. A waste basket 23 is removably attached to the underside of the floor 13 and the opening of the basket 23 covers the opening 22 in the floor 13.

A cleaning cycle for the floor 13 will now be described with reference to FIGS. 3–6, schematically showing the floor 13, the edge 20 of the inner wall 8 and the cleaning device for the floor.

Figure 3:
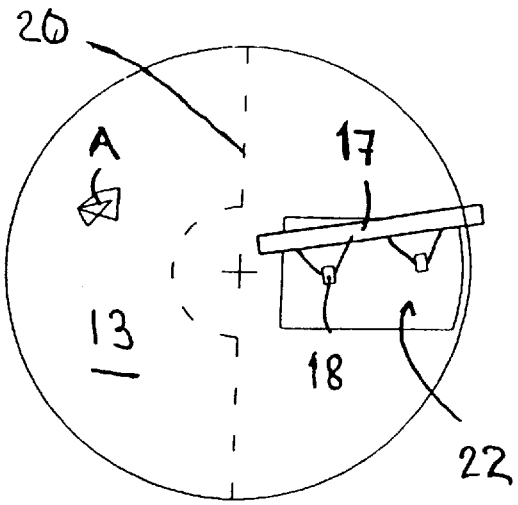
FIGS. 3–6 are schematic plan views of the floor of the toilet and its cleaning device during a cleaning cycle.
Figure 4:
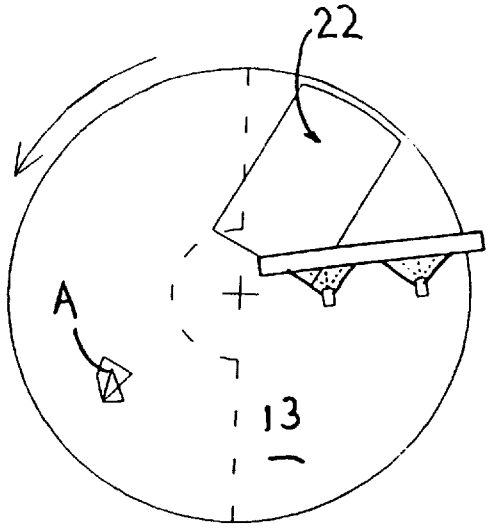
Figure 5:
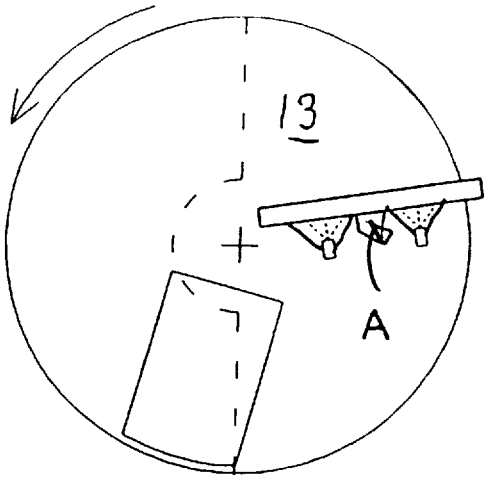
Figure 6:
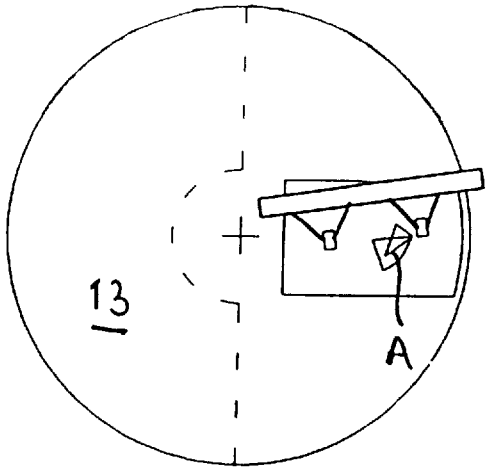

In FIG. 3, the person using the toilet has just left leaving a waste paper A on the floor 13. Thereafter the rotation of the floor 13 is started and the supply of cleaning liquid to the nozzles 18 is started after a short delay making it possible for the opening 22 to move past the row of nozzles 18. This position is shown in FIG. 4. The waste paper A moves with the floor and will eventually reach the scraper carried by the bar 17 which will prevent the waste paper from further movement in a rotational direction, as is evident from FIG. 5. When the opening 22 after having passed through the public part of the toilet, i.e. the part to the left of edge 20 in FIGS. 3–6, leaves the public part, the supply of cleaning liquid to the nozzles 18 is shut off. When the leading edge of the opening 22 just has passed the scraper carried by the bar 17, the rotation of the floor 13 is stopped and the cleaning cycle is ended. The waste paper A will then fall down into the waste basket 23 though the opening 22 as indicated in FIG. 6 showing the floor after a cleaning cycle has been performed.

The scraper 21 functions in the same way as a wiper for a vehicle window so that substantially all cleaning liquid has been wiped off the floor 13 after it has passed the scraper during a cleaning cycle. The dirty liquid obstructed from flowing in a rotational direction by the scraper will also flow into the opening 22 in the end of the cleaning cycle. In order to prevent fluid from flowing past the scraper in the central area of the floor or past the edge of the floor 13 and onto the ground floor 3, the floor 13 can be perforated so that the liquid caught by the scraper immediately can leave the floor through these perforations. The downwardly directed nozzles 18 are preferable inclined in the rotational direction of the floor, i.e. in a direction towards the scraper.

In the roof 2, movement sensors are preferably installed as well as a disinfection spraying device. In the service part 10, a control device, for example a microprocessor, controlling all operations of the door 11, the floor 13 and all cleaning devices is installed. All information from the different sensors is fed to this device. The floor 13 is preferably slidably supported by the side walls 6,7 in the public part thereof. Moreover, weigth[sic] sensors is preferably provided for detecting a person standing on the floor, these sensors being placed in its support in the ground floor and/or in the possible supports in the side walls. The possible support for the floor 13 in the side walls can for example consist of a flange that is in contact with the circumference of the floor only when the floor is loaded by a person standing on the floor.

The automatic public toilet functions in the following way. A person wanting to use the toilet inserts a coin in a coin slot of a coin apparatus accessible from the outside of the toilet. Access to the toilet is thereby allowed for a certain time, for example twenty minutes. When the user of the toilet has left the public area, which is automatically determined with the help of the different sensors installed therein, the control device initiates the self-cleaning devices for the lavatory unit, the sink and the floor as well as the activation of the rotation mechanism for the floor. During these operations the public area is closed to the public and this fact is indicated by a sign or the like on the outside of the toilet. When the cleaning operations are finished followed by a possible drying of the public area with hot air or of the cleaned object by individual drying devices, the toilet is ready to be used again.

The described embodiment can be modified in several ways within the scope of the present invention. For example the waste basket need not be attached to the floor 13 but could be placed on the ground floor under the bar 17. Such a placing of the basket is preferred when the floor is slidably supported by the side walls in the public part of the toilet since the supports and sliding devices in these walls will restrict the space available for attachment of the basket to the underside of the floor. The waste basket can be deleted and the waste can be gathered directly on the ground floor. The opening 22 in the floor 13 could be larger than in the disclosed embodiment and can in the extreme have a semi-circular form, i.e. the floor is only extended in the public part of the toilet when the toilet is ready for use. The row of nozzles 18 can be supported by other means than the bar 17. In such a case, the bar is a scraper and need not be hollow but can consist of a rubber strip. The scope of the invention shall therefore only be limited by the wording of the enclosed set of Claims.

What is claimed is:

1. An automatic public toilet for outdoor use having a public part confined by a roof, four walls and a floor, and comprising a lavatory unit including a toilet seat and bowl, the lavatory unit being supported on a wall of the toilet, wherein the floor is movable into and out of the public part of the toilet and a cleaning device for the floor is placed outside the public part, wherein the floor is rotatable around a vertical axis, wherein the cleaning device for the floor is disposed in a service part of the toilet and consists of a row of downwardly directed spray nozzles and a scraper, wherein the row of downwardly directed spray nozzles is supported by an elongated hollow bar and extend along the length thereof, the bar being extended in a horizontal direction from near the rotational center of the floor and having the scraper provided on an underside thereof, and wherein the floor is circular and contains an opening which extends radially from near the center of the floor to the perimeter thereof or to a point near the perimeter of the floor.

2. The toilet according to claim 1, wherein a waste basket having an opening with the same area as the opening in the floor is attached to the underside of the floor.

3. The toilet according to claim 1, wherein a waste basket having the same longitudinal extension as the opening in the floor is attached to the underside of the floor.

4. The toilet according to claim 1, wherein the floor is perforated.

* * * * *